US005155916A

United States Patent [19]

Engebretson

[11] Patent Number: 5,155,916

[45] Date of Patent: Oct. 20, 1992

[54] ERROR REDUCTION IN COMPENSATION OF DRILL STRING INTERFERENCE FOR MAGNETIC SURVEY TOOLS

[75] Inventor: Harold Engebretson, Longbranch, Wash.

[73] Assignee: Scientific Drilling International, Houston, Tex.

[21] Appl. No.: 673,083

[22] Filed: Mar. 21, 1991

[51] Int. Cl.[5] ..... E21B 47/022

[52] U.S. Cl. ..... 33/302; 33/304; 33/313

[58] Field of Search ..... 33/302, 304, 310, 312, 33/313

[56] References Cited

U.S. PATENT DOCUMENTS

| | | | |
|---|---|---|---|
| Re. 33,708 | 10/1991 | Roesler | 33/313 |
| 3,587,175 | 6/1971 | Armistead | 33/312 |
| 3,791,043 | 2/1974 | Russell | 33/312 |
| 3,896,412 | 7/1975 | Rohr | 33/304 |
| 4,163,324 | 8/1979 | Russell et al. | 33/313 |
| 4,433,491 | 2/1984 | Ott et al. | 33/302 |
| 4,510,696 | 4/1985 | Roesler | 33/304 |
| 4,649,349 | 3/1987 | Chiron et al. | 33/313 |
| 4,682,421 | 7/1987 | van Dongen et al. | 33/302 |
| 4,709,486 | 12/1987 | Walters | 33/304 |
| 4,761,889 | 8/1988 | Cobern et al. | 33/302 |
| 4,813,214 | 3/1989 | DiPersio et al. | 33/313 |
| 4,819,336 | 4/1989 | Russell | 33/304 |
| 4,956,921 | 9/1990 | Coles | 33/302 |
| 4,999,920 | 3/1991 | Russell et al. | 33/312 |
| 5,012,412 | 4/1991 | Helm | 33/313 |

FOREIGN PATENT DOCUMENTS

| | | |
|---|---|---|
| 1240830 | 7/1971 | United Kingdom . |
| 2138141 | 10/1984 | United Kingdom . |
| 2158587 | 11/1985 | United Kingdom . |
| 2185580 | 7/1987 | United Kingdom . |

*Primary Examiner*—Thomas B. Will
*Attorney, Agent, or Firm*—William W. Haefliger

[57] ABSTRACT

A method for determining the orientation of the axis of a borehole with respect to an earth-fixed reference coordinate system at a location in the borehole comprising the steps of: measuring two cross-borehole components or two-cross-borehole components and an axial component of the earth's gravity field at a location in the borehole; measuring two cross-borehole components of the earth's magnetic field; determining the inclination angle of the borehole axis from the gravity component measurements; determining the highside angle reference of the cross-borehole measured components of the earth's gravity and magnetic fields from the gravity component measurements; determining more than one individual estimate of the azimuthal orientation of the borehole axis from the inclination angle, the highside angle reference and the two measured cross-borehole components of the earth's magnetic field; determining an error indicative parameter for each individual estimate of the azimuthal orientation of the borehole axis; and determining a single estimate of the azimuthal orientation of the borehole axis based on the individual estimates of azimuthal orientation and the error indicative parameters for each estimate.

39 Claims, 7 Drawing Sheets

(LOOKING DOWNWARD ALONG D)

(LOOKING TOWARD THE ORIGIN FROM E)

(LOOKING DOWNWARD ALONG z)

ERROR REDUCTION IN COMPENSATION OF DRILL STRING INTERFERENCE FOR MAGNETIC SURVEY TOOLS

BACKGROUND OF THE INVENTION

It is generally well known that magnetic survey tools are disturbed in varying ways by anomalous magnetic fields associated with fixed or induced fields in elements of the drill string. It is further well known that the predominant error component lies along the axis of the drill string. This latter fact is the basis for several patented or patent-applied-for procedures to eliminate the along-axis field errors in three-magnetometer survey tools. Among these are U.S. Pat. No. 4,163,324 to Russell et al; U.S. Pat. No. 4,433,491 to Ott et al; U.S. Pat. No. 4,510,696 to Roesler; U.S. Pat. No. 4,709,486 to Walters and U.S. Pat. No. 4,818,336 to Russell; and applications for U. K. Patents 2,138,141A to Russell et al; and U.S. Pat. No. 2,185,580 to Russell; as well as European application 0 193 230 and U.S. Pat. No. 4,682,421 to Van Dongen.

All of these methods, in effect, ignore the output of the along-axis magnetometer, except perhaps for selecting a sign for a square root computation. They provide an azimuth output by computation of a synthetic solution, either:

1) by using only the two cross-axis magnetometers and known characteristics of the earth's field, or 2) by using the cross-axis components and an along-axis component computed from the cross-axis components and known characteristics of the earth's field.

Most of these methods require, as the known characteristics of the earth field, one or more of the following:

1) Field Magnitude
2) Dip Angle
3) Horizontal Component
4) Vertical Component

The Walters method requires, as known characteristics of the earth field, only that:

1) The Field Magnitude is constant in the survey area.
2) The Dip Angle is constant in the survey area.

The fact that these quantities are constant is all that is required. The value of the constant is not needed but is derived within the correction algorithm.

It may be shown that in all of the individual methods of the above references, the final error in the computed azimuthal orientation of the borehole axis is completely independent of the along-borehole magnetic measurement and therefore the along-borehole component of the drill string interference. This is true because that measurement is simply not used in any manner that affects the final computed result. However, it may also be shown that all of the cited methods introduce other errors that are functions of the sensor errors for those sensor outputs used, errors in the reference information related to the earth's magnetic field used in the solutions, and the orientation of the borehole axis in azimuth and inclination. These factors lead to a result that no single method of compensation for drill string interference will provide the smallest error for all orientations of the borehole axis. Further, the complexity of the error relations for the various individual methods leads to a difficult problem for survey operators to understand the error regions and magnitudes. Of particular concern is that as the borehole may progress, the changes in borehole orientation cause different errors at each survey station. Often, no single method can provide minimum error for all stations along the path.

SUMMARY OF THE INVENTION

It is therefore a major objective of this invention to provide a method of compensating magnetic surveys of boreholes that eliminates the influence of along-borehole drill string interference and that minimizes the error in the result for all orientations of the borehole with respect to azimuth and inclination. It is a further objective to provide a method that accomplishes such compensation in a manner that does not require operator judgment or action. Another objective of the invention is to provide a quantative estimate of the error in the final computed result, based on the sensor errors for those sensors used, the errors in the reference earth magnetic field data used, and the orientation of the borehole in azimuth and inclination at each survey station along the borehole path.

The present invention provides a method of correcting for drill string interference that allows minimization of the error in the final azimuthal orientation of a borehole for all orientations of the borehole along its trajectory. Since the errors in each of the above listed prior methods depend upon the errors in the sensors used, the errors in the reference data on the earth's magnetic field used and the orientation of the borehole in azimuth and inclination, it is first necessary to understand the error sensitivities of the various methods. To achieve this end, basic error sensitivities for a generic survey tool have been developed. Then, the error sensitivities for four known methods for compensation of drill string magnetic interference were developed to show their dependence on Earth magnetic field reference errors, sensor errors, and the orientation of the borehole in azimuth and inclination. Each of the four methods for which error sensitivites were developed show distinctly different orientation sensitivities and Earth reference field sensitivities.

The basic invention as described herein combines the analytical results on error sensitivities into a single method that produces a single estimate of the borehole azimuthal orientation at each survey station, without the requirement for the survey operator to make any judgments with respect to which of the various individual estimates by an individual method have any particular advantage or disadvantage. Also, the method of the invention provides a single estimate of the probable error in the estimated azimuthal orientation for each survey station.

The method of the invention includes the steps of:

1) measuring at each survey station location in the borehole the components of the Earth's gravity field and the cross-borehole components of the Earth's magnetic field;

2) determining more than one estimate of the azimuthal orientation of the borehole from these measurements and known parameters of the Earth's magnetic field;

3) determining an error indicative parameter for each of the individual estimates of azimuthal orientation;

4) determining a single estimate of the azimuthal orientation from the individual estimates and their associated error indicative parameters in such a manner as to reduce to a minimum the probable error in the single estimate; and 5) determining an error indicative parameter for the final single estimate of azimuthal orientation.

Alternative formulations based on determining a single estimate of the cosine of the azimuthal orientation angle or a synthetically derived value for the Earth's magnetic field along the borehole axis from multiple individual estimates and their associated error indicative parameters are also shown.

More broadly, the invention involves a method for determining the orientation of the axis of a borehole with respect to an earth-fixed reference coordinate system at a location in the borehole, comprising the steps of:

a) measuring one of the following:

i) two cross-borehole components, ii) two cross-borehole components and an along-borehole component, of the earth's gravity field, at said location in the borehole, b) measuring two cross-borehole components of the earth's magnetic field at said locations, and c) processing said step a) and step b) measured components to determine multiple estimates of the azimuthal orientation of the borehole axis, such multiple estimates having different errors, that are then combined to derive a single estimate of azimuthal orientation of the borehole axis of minimum error.

These and other objects and advantages of the invention, as well as the details of an illustrative embodiment, will be more fully understood from the following specification and drawings, in which:

DRAWING DESCRIPTION

FIG. 1 shows a typical borehole and drill string including a magnetic survey tool;

FIG. 1*a* is an enlarged view of a portion of FIG. 1;

FIGS. 2*a*–2*d* show a coordinate set in relation to a borehole;

DETAILED DESCRIPTION

Figure 1:
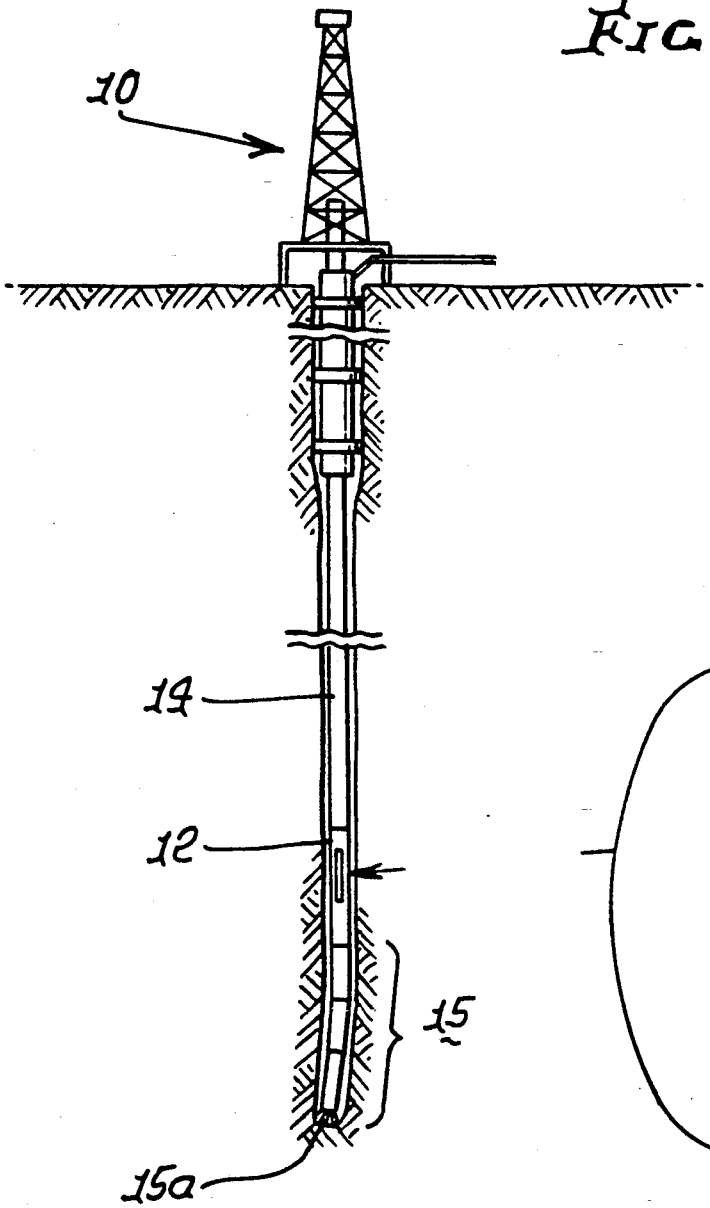
Figure 1A:
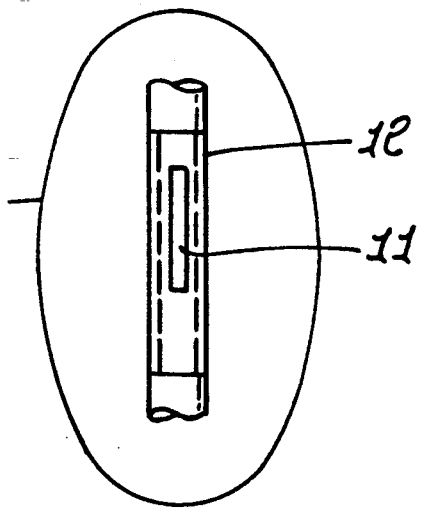

FIG. 1 shows a typical drilling rig 10 and borehole 13 in section. As seen in FIGS. 1 and 1*a*, a magnetic survey tool 11, is shown contained in a non-magnetic drill collar 12, (made for example of Monel or other non-magnetic material) extending in line along the borehole 13, and the drill string 14. The magnetic survey tool is generally of the type described in U.S. Pat. No. 3,862,499 to Isham et al, incorporated herein by reference. It contains three nominally orthogonal magnetometers and three nominally orthogonal accelerometers for sensing components of the Earth's magnetic and gravity fields. The drill string 14 above the non-magnetic collar 12 is of ferromagnetic material (for example, steel) having a permeability that is high compared to that of the earth surrounding the borehole and the non-magnetic collar. There may, or may not, be other ferromagnetic materials contained in the drill assembly 15 below the non-magnetic collar, and including bit 15*a*. It is generally well known that the ferromagnetic materials above, and possibly below, the non-magnetic collar 12 cause anomalies in the earth's magnetic field in the region of the survey tool that in turn cause errors in the measurement of the azimuthal direction of the survey tool. It is also well known from both theoretical considerations and experiment that the predominant error field lies along the direction of the drill string. It is this latter knowledge that the predominant error lies along the drill string direction that has led to all of the previously cited methods to eliminate such an error component. As previously stated, all such methods discard the measurement along the drill string axis and find either a two-component solution or a three-component solution in which the third component is computed mathematically. As previously cited, the assumption used is that the along-borehole error is the predominant error and that by not using the measurement along the borehole axis the error is avoided.

Figure 2A:
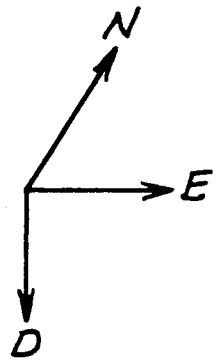
Figure 2B:
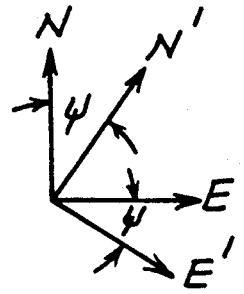
Figure 2C:
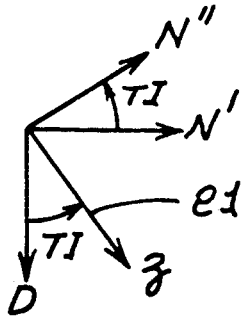
Figure 2D:
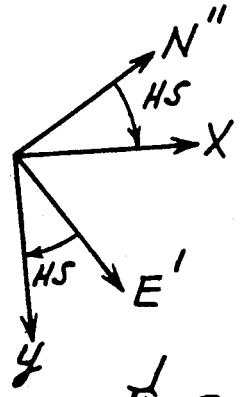

FIG. 2*a* shows an N(North), E(East), D(Down) coordinate set. Defining the Earth's magnetic field as the vector, H, having components Hx, Hy, Hz, along the three axes of the survey tool 11, the measurement outputs of the three magnetometers in the survey tool will be:

x-Magnetometer: Hx y-Magnetometer: Hy z-Magnetometer: Hz in the absence of any disturbances from magnetic materials in the drill string.

Starting with the three-axis Earth-fixed coordinate set, $\underline{N}$, $\underline{E}$, $\underline{D}$, (representing North, East, and Down) where the underline represents a unit vector in the direction given, the orientation of a set of tool axes $\underline{x}$, $\underline{y}$, $\underline{z}$, is defined by a series of rotation angles, AZ, $\overline{TI}$, $\overline{HS}$, (representing AZimuth, TIlt, and HighSide). In this nomenclature x is rotated by HS from the vertical plane, y is normal to x, and z, the direction of a borehole axis 21, that is assumed to be co-linear with the drill string 14 of FIG. 1, is down along the borehole axis. The formulation of the calculation of azimuth, adapted from U.S. Pat. No. 3,862,499 is:

$$AZ = \text{Arctan}\frac{-(Hx^*\text{Sin}(HS) + Hy^*\text{Cos}(HS))}{\text{Cos}(TI)^*(Hx^*\text{Cos}(HS) - Hy^*\text{Sin}(HS)) + Hz^*\text{Sin}(TI)} \quad \text{(Eq. 1)}$$

where * denotes multiplication. In this equation Hx, Hy, and Hz are the three magnetometer measured components. The angles TI and HS are solved from the three accelerometer measured components by well known methods in previous steps.

It will be seen that errors in any of the terms in the equation (1) may lead to errors in the computed azimuth. Accelerometer error sources contribute to errors in TI and HS and magnetometer or anomalous magnetic fields contribute to errors in Hx, Hy, and Hz. Ignoring errors related to TI and HS, direct differentiation of the AZ equation with respect to the three magnetometer outputs can be carried out and reduced mathematically to show the correct relation of differential AZ errors to the source differential H errors. This relation is:

$$dAZ = \frac{-dH \cdot E}{H\text{north}} \quad \text{(Eq. 2)}$$

where dAZ is the differential azimuth error angle in radians, Hnorth is the horizontal components of the Earth's magnetic field at the location of the survey, $d\underline{H}$ is the error vector for the output of the three-magnetometer set including any anomalous fields from the drill string $\underline{E}$ is the unit vector in the East direction and the dot between $d\underline{H}$ and $\underline{E}$ denotes the vector dot product. Thus the azimuth error is the vector dot product of the magnetometer output error vector and a unit vector in the East direction divided by the horizontal component of the Earth's field at the particular location.

This simple formulation permits some direct visualization of the effects of various error sources. First, for any given magnetometer output error, the azimuth error is inversely proportional to the horizontal component of the Earth's field. Since this component may vary from, on the order of 40,000 nT (nanoTesla) in Southeast Asia, to around 10,000 nT in the Alaska North Slope region, any given survey tool would be expected to have errors in the North Slope region that are on the order of four times what the same tool would produce in Southeast Asia. The error vector $d\underline{H}$ comprises the three components:

$$dH = dHx*x + dHy*y + dHz*z \quad \text{(Eq.3)}$$

where $\underline{x}$, $\underline{y}$, and $\underline{z}$ are unit vectors in the x, y, z directions in the tool, and dHx, dHy, and dHz are the scalar magnitudes of the errors in the three vector directions. Considering these three scalar magnitudes to be random variables of any distribution, as long as all three components have the same magnitude and distribution, the net error vector $d\underline{H}$ will be uniformly distributed, spherically. For such a spherical distribution, the dot product of this vector and the unit vector $\underline{E}$ in the East direction, (see Eq. 2), will not vary for any orientation of the survey tool in relation to the earth-fixed axes. The expected azimuth error is thus invariant for all orientations. The basic magnetometer errors can be expected to demonstrate such a symmetry in their random components, and thus the azimuth error resulting from such errors will not show any orientation dependence.

It is generally well known that the anomalous magnetic fields associated with the drill string and bottom-hole assembly lead to much more significant errors in the along-borehole, z, direction than in the cross-borehole x and y directions. Such errors due to anomalous fields are thus primarily errors in the along-borehole measurement error, dHz. Considering this component alone, any error dHz translates directly then into:

$$dAZ = \frac{dHz*\text{Sin}(AZ)*\text{Sin}(TI)}{H\text{north}} \quad \text{(Eq. 4)}$$

when the dot product in equation (2) is evaluated. This confirms the well known result that drill-string and bottom-hole fields do not disturb azimuth in near vertical or North/South boreholes, but that errors increase as the azimuth tends to East/West and the inclination increases toward horizontal.

Several methods have been described to overcome the effects on three-axis magnetometer-based survey tools of the along-borehole anomalous magnetic fields resulting from the iron based materials in the drill string and bottom hole assembly. Four approaches are discussed below in terms of what the approach is, what errors are eliminated by the approach, and what errors are substituted for those eliminated. Where they have been derived, explicit error equations are presented. In general, the treatment will be in historical sequence as found in the referenced literature.

A method developed by Ott et al, U.S. Pat. No. 4,433,491, describes a means for determining azimuth using either rate-gyroscope or magnetometer tools in which there are only cross-axis measurements to work with. In this work it was recognized that in a formulation such as Equation 1, the numerator of the expression is equal to Hnorth*Sin(AZ) and the denominator is equal to Hnorth*Cos(AZ). An alternative expression may be found for Hnorth*Cos(AZ) that does not include the z-axis measurement Hz:

$$H\text{north}*\text{Cos}(AZ) = \frac{\{Hx*\text{Cos}(HS) - Hy*\text{Sin}(HS) + H\text{vertical}*\text{Sin}(TI)\}}{\text{Cos}(TI)} \quad \text{(Eq. 5)}$$

In this expression the value of the vertical component of the Earth's field is introduced. Thus, there is no need for a z-axis magnetometer and the anomalous along-borehole effect of drill string interference is never sensed or seen. With this expression (the right side of Equation 5) substituted for the denominator of Equation 1 as shown in the Ott version, an explicit value of azimuth is directly computed. This form does have the difficulty of possible division by zero for inclination angles, TI, of 90 degrees. This is avoided in some references by showing the numerator of Equation 1 multiplied by Cos(TI) and the rest of Equation 5 used as the denominator. This is not really any help since the numerator of Equation 5 also will be near zero for an inclination of 90 degrees so that the Arctan function is sought for an indeterminate form "zero/zero". This was recognized in Ott et al and also it was seen that there was essentially no information content when the borehole direction approached an East/West direction. The first part of the problem was shown to be avoided by recognizing that, since the numerator of Equation 1 was equal to Hnorth*Sin(AZ), the azimuth could be computed alternatively as:

$$AZ = \text{Arcsin}\,\frac{-(Hx*\text{Sin}(HS) + Hy*\text{Cos}(HS))}{H\text{north}} \quad \text{(Eq. 6)}$$

An alternative equivalent form is:

$$AZ = \text{Arctan}\,\frac{-(Hx*\text{Sin}(HS) + Hy*\text{Cos}(HS))}{SQR(H\text{north}\ \ 2 - (Hx*\text{Sin}(HS) + Hy*\text{Cos}(HS))\ \ 2)} \quad \text{(Eq. 7)}$$

In the above, means "exponent" and SQR is the square root operator. These avoid completely the Cos(TI) problem near 90 degrees inclination but provide poor accuracy at azimuths near East/West for all inclinations.

It may, by direct differentiation of Equations 5 and 6, be shown that the differential azimuth error for the Arctan solution is, for HS=O:

$$daZ(\text{Arctam}) = \frac{\text{Sin}(AZ)*(dHx - \text{Sin}(TI)*dH\text{vertical})}{N\text{north}*\text{Cos}(TI)} - \frac{\text{Cos}(AZ)*dHy}{H\text{north}} \quad \text{(Eq. 8)}$$

and for the Arcsin solution:

$$dAZ(\text{Arcsin}) = \frac{*dHy}{\text{Coz}(AZ)*H\text{north}} + \frac{\text{Sin}(AZ)*dH\text{north}}{\text{Cos}(AZ)*H\text{north}} \quad \text{(Eq. 9)}$$

In the first of these, the error dHvertical is included and it is in effect magnified for increasing inclination by the division by Cos(TI), and in the second of these dHnorth is included with increasing magnitude as azimuth approaches East/West.

It is clear that the along-borehole anomalous field errors are completely eliminated and errors in the knowledge of the Earth's field are substituted. Therefore, the benefits of the correction algorithm depend on the relative magnitudes of what is desired to be avoided vs. the uncertainties in reference data. Forms identical to the Arctan (U.S. Pat. Nos. 4,510,696 and 4,819,336 and U.K. Patent Applications GB 2,138,141A and GB 2,185,580 A) and the Arcsin (U.S. Pat. No. 4,819,336 and U.K. Patent Application GB 2,185,336) solutions have been shown. Although the symbols used vary to some extent, the same differential errors result since they do exactly the same computation.

Since, as the previous two general methods have shown, the object is to avoid including the anomalous z-axis errors in the solution, several sources (U.S. Pat. Nos. 4,244,116, 4,433,491 and 4,819,336) have suggested that when two components of a known total vector field are known, that the third component may be computed from the known total field value and the known two components. For example one can compute:

$$Hz=SQR\{(Htotal)\ 2-Hx\ 2-Hy\ 2\} \qquad \text{(Eq.10)}$$

where "SQR" is the square root operator. If one could determine the correct sign to use for the square root, one could then use this value in place of the measured Hz in Equation 1 to find azimuth without the drill string errors associated with the measured component. Given a z-axis magnetometer one could choose the sign of the computed component to be that of the measured component. Alternatively, one could choose the sign that most closely results in some known characteristic, such as the dot or cross product of the gravity field (as measured by the accelerometers) and the magnetic field, as determined by two magnetometer-measured components and the computed component. Since the z-axis errors are only a few percent, the only problem with sign occurs when the true component is near zero and then neither of these methods is very sensitive to the correct answer. Nevertheless, the method is useful for a wide range of cases. Since Equation 1 is to be used for the computation, the direct way to compute error is to compute the error in Equation 10, and then use Equation 2 to find the azimuth error. The differential error in the computed Hz value is given by:

$$dHz(\text{computed}) = \frac{(H\text{total}*dH\text{total} - Hx*dHx - Hy*dHy)}{Hz} \qquad \text{(Eq. 11)}$$

The differential error in the computed value depends on the differential errors in Htotal, Hx, and Hy. It is also inversely proportional to Hz itself. Thus the error becomes very large when the true Hz is small. This is true when the borehole axis tends toward being perpendicular to the Earth's total field vector. This includes the high inclination angle, near East/West region previously cited as sensitive regions for some of the solutions. It also contains all of the plane normal to the Earth's total field vector.

In using Equation 11 with Equation 2, care must be taken in the evaluation of the resulting error since the errors dHx and dHy will appear in two different places in Equation 2. If root-sum-square combinations are being computed from statistical errors, the correlation resulting from this dual appearance must be taken into account.

Looking at this result and the two previous forms shown for the Ott et al Arctan and Arcsin solutions, it can be noted that for any of these forms the sensitive error region is the plane that is perpendicular to the reference vector used to avoid the z-axis problem. The Arcsin solution uses the Hnorth vector and the error region is the entire East/West plane. The Arctan solution uses the Hvertical vector and the serious error region is the entire horizontal plane, and for the magnitude solution the serious error region is the entire plane perpendicular to the Htotal vector. This is as it should be, since there is no measurement data in the plane normal to the reference vector being used.

One method developed by Walters (U.S. Pat. No. 4,709,486) for correction of along-axis errors does not require any knowledge as to the local field magnitude, direction, or components and thus eliminates the z-axis field errors without introducing systematic errors from the reference data. This method only requires the assumptions that:

1) In the region of the survey, the magnitude of the Earth's field is a constant.

2) In the region of the survey, the direction of the Earth's field is a constant, namely the Dip Angle is constant.

What is required is the constancy of these terms, not their values. The method is based on defining the magnitude of the field as the square root of the sums of the squares of the three components and recognizing, as in the previous method, that the Dip Angle is directly related to the dot product of the magnetic and gravity vectors. With measurements from two different survey stations two equations may be written to express these conditions. These are:

$$Hx(1)\ 2+Hy(1)\ 2+Hz(1)\ 2=Hx(2)\ 2-+Hy(2)\ 2+Hz(2)\ 2 \qquad \text{(Eq. 12)}$$

$$Hx(1)*Gx(1)+Hy(1)-*Gy(1)+Hz(1)*Gz(1)=Hx(2)*Gx(2)+Hy(2)-*Gy(2)+Hz(2)*Gz(2) \qquad \text{(Eq. 13)}$$

where "H" refers to magnetic vector value, and "G" refers to gravity vector value.

If one accepts as valid measurements all of the values except Hz(1) and Hz(2), then these two equations can be solved treating these two terms as unknowns and no outside errors have been introduced from reference information. Also, after solving for one or both of the "unknown but correct" z-axis terms, the total field and dip angle can be computed and the results of this computation used in any of the methods described above that require knowledge of the Earth's field and/or its components.

One important aspect of this method is a condition on the two survey stations that are used for computation. There must be some separation in the angular orientation of the two stations or else the data from the two stations is perfectly correlated except for noise and the solution will be indeterminate. The cited reference shows a required separation of at least five degrees in angular orientation. In the reference, the solution shown results in an equation that has a denominator:

$$2*(1-(Gz(1)/Gz(2))\ 2) \qquad \text{(Eq.14)}$$

This value depends directly on the change in inclination between the two survey stations and also on the absolute value of the inclination for a given change. Thus the final error in the computation of the "unknown but correct" z-axis values is a complex function of the errors in all of the other measurements divided by the value of Equation 14.

Another solution to Equations 12 and 13 has been developed that makes a direct evaluation of errors in the determined Hz values possible. The result is a complex expression of the parameters of the borehole geometry and the sensor errors. The dominant factor is that this expression includes as its denominator the term:

$$Hz(1)*Gz(2)-Hz(2)*Gz(1) \quad \text{(Eq. 15)}$$

This shows that the error is not simply a function of the difference in the hole direction but how the direction changes. Like the other methods shown, this method also degrades in accuracy such that it is not of use for high inclination boreholes having an azimuth near East/West.

The above discussions of alternative estimates of the azimuthal orientation of a borehole based on cross-borehole measurements of components of the Earth's magnetic field, and the errors in each such estimate as a function of reference and sensor errors and the borehole orientation, show the complexity of the problem and the clear result that none of the individual methods shown will produce minimum error for all orientations of the wellbore. As an example of the problem, Table 1 below shows the profile of a possible wellbore trajectory chosen to illustrate the points of the above analyses. For the purposes of this example, it is assumed that the sensor errors are all negligible and therefore the only errors considered are those due to drill string interference and errors in the reference data used for the Earth's "known" properties. In this table, the columns labeled AZ and TI represent Azimuth and Tilt of the true borehole. The remaining columns are defined as:

1) AZ(0) is the uncorrected azimuth including the influence of the drill string magnetization error.

2) ERR(0) is the difference between AZ(0) (the uncorrected azimuth) and AZ (the true borehole azimuth).

3) AZ(1) is the azimuth estimate computed using Equation 5 and an assumed value of Hvertical, the vertical component of the Earth's magnetic field, to replace the denominator of Equation 1.

4) ERR(1) is the expected error in AZ(1) computed from Equation 8 using an assumed value for dHvertical, the uncertainty in the assumed value of Hvertical.

5) AZ(2) is the azimuth estimate computed using Equation 6 and an assumed value of Hnorth, the horizontal component of the Earth's magnetic field.

6) ERR(2) is the expected error in AZ(2) computed from Equation 9 using an assumed value for dHnorth, the uncertainty in the assumed value of Hnorth.

7) AZ(3) is the azimuth estimate computed using Equation 10 and an assumed value of Htotal, the total magnitude of the Earth's magnetic field, to replace Hz in the denominator of Equation 1.

8) ERR(3) is the expected error in AZ(3) computed by using Equation 11 with an assumed value for dHtotal, the uncertainty in the assumed value of Htotal, to compute an error dHz(computed) that is in turn used in Equation 4 to compute the azimuth error.

The values in Table 1 were computed for a condition representative of the North Sea region using an assumed total Earth magnetic field of 50,000 nT (nanoTesla) and a dip angle of 70 degrees. The assumed drill string interference is 500 nT. The uncertainties in Hvertical, Hnorth and Htotal were assumed to be 100 nT. These values must be evaluated for any particular survey region of the Earth based on what information may be available. As previously stated, all sensor errors are considered to be negligible in comparison to the reference and drill string interference errors. All AZ, TI and ERR values are in degrees. Since the drill string error and the errors dHvertical, dHnorth and dHtotal are considered as random errors, no sign is associated with the ERR terms. Also, for convenience, if a computed error is less than 0.25 degrees, it is assigned the value of 0.25 degrees and if it is larger than 10 degrees, it is assigned the value of 10 degrees.

TABLE 1

| | | Comparison of Error-correction Methods | | | | | | | |
|---|---|---|---|---|---|---|---|---|---|
| TI | AZ | AZ (0) | ERR (0) | AZ (1) | ERR (1) | AZ (2) | ERR (2) | AZ (3) | ERR (3) |
| 5 | 90 | 89.85 | 0.15 | 89.97 | 0.25 | 83.82 | 10.0 | 89.97 | 0.25 |
| 10 | 95 | 94.71 | 0.29 | 94.94 | 0.25 | 97.94 | 3.8 | 94.94 | 0.25 |
| 15 | 100 | 99.57 | 0.43 | 99.91 | 0.25 | 101.74 | 1.9 | 99.90 | 0.25 |
| 20 | 105 | 104.44 | 0.56 | 104.88 | 0.25 | 106.20 | 1.3 | 104.87 | 0.25 |
| 30 | 115 | 114.24 | 0.76 | 114.82 | 0.25 | 115.71 | 0.72 | 114.80 | 0.25 |
| 40 | 120 | 119.06 | 0.94 | 119.76 | 0.25 | 120.57 | 0.58 | 119.69 | 0.31 |
| 50 | 130 | 129.00 | 1.00 | 129.69 | 0.31 | 130.36 | 0.40 | 129.55 | 0.45 |
| 60 | 140 | 139.05 | 0.95 | 139.62 | 0.37 | 140.28 | 0.28 | 139.23 | 0.77 |
| 70 | 150 | 149.19 | 0.81 | 149.53 | 0.46 | 150.19 | 0.25 | 147.14 | 3.66 |
| 80 | 120 | 118.55 | 1.45 | 118.33 | 1.64 | 120.57 | 0.58 | 109.23 | 10.0 |
| 90 | 120 | 118.53 | 1.47 | 180.0* | 10.0 | 120.57 | 0.58 | 121.62 | 1.70 |
| 90 | 105 | 103.37 | 1.63 | 180.0* | 10.0 | 106.20 | 1.3 | 108.23 | 3.66 |
| 90 | 90 | 88.33 | 1.67 | 180.0* | 10.0 | 83.82 | 10.0 | 79.52 | 10.0 |

Note:
*indicates error, divide by zero, results in 180

The three entries noted at 180 are the result of the exact assumed inclination of 90 degrees, for which the cosine is zero. In normal computation, such an exact result would be of very low probability.

It can be readily seen that the errors in the various individual methods change greatly over the range of azimuths and tilts of the borehole trajectory. Also, it may be seen that in some cases the error in a computed correction intended to remove the influence of drill string interference is greater than the error caused by drill string interference. It is also evident that not one of the individual methods shows the smallest error for all stations along the borehole trajectory. The problem for a survey operator to select the method of correction to apply, and then complete the calculation of a survey, is very complex. Also, it is difficult for the operator to make a judgment as to the probable error in his results for each station.

The problem created by examples such as that shown in Table 1 may be directly addressed by using all of the different estimates of azimuth together with their expected error parameters to compute a weighted single estimate from the individual estimates. If all of the individual estimates had nearly the same value for their error parameters, a simple averaging of the individual results would be suitable. However, as seen in Table 1, there is a ratio of 40 to 1 in the error parameters. The range would be even greater if the limits of 0.25 and 10 had not been used.

It is well known in the statistical mathematical arts that a weighted mean of a number of individual estimates in which the weight assigned to each estimate depends on the error parameters associated with each estimate can provide a smaller error in the weighted mean than that of any one of the individual estimates. It is further well known that if the error parameters for the individual errors are random and not correlated with each other, the weighting that minimizes the error in the single weighted mean is one that weights each estimate in inverse relation to its variance. For normally distributed errors, the variance is equal to the square of the standard deviation of the error parameter. Further the sum of the weighting factors must be unity. Applying this approach to the borehole survey problem as shown in Table 1 above leads to:

$$AZ(\text{weighted}) = W(1)*AZ(1) + W(2)*AZ(2) + W(3)*AZ(3) \quad \text{(Eq.16)}$$

where:

$$K = 1/ERR(1)\ \ 2 + 1/ERR(2)\ \ 1 + 1/ERR(3)\ \ 2 \quad \text{(Eq.17)}$$

$$W(1) = 1/(K*ERR(1)\ \ 2) \quad \text{(Eq.18)}$$

$$W(2) = 1/(K*ERR(2)\ \ 2) \quad \text{(Eq.19)}$$

$$W(3) = 1/(K*ERR(3)\ \ 2) \quad \text{(Eq.20)}$$

Further, the expected error in AZ(weighted) is:

$$ERR(\text{weighted}) = 1/\text{SquareRoot}(K) \quad \text{(Eq.21)}$$

If the Equations 16 through 21 are applied to the corrected data columns in Table 1, the result shown in Table 2 is obtained. Again for convenience, if the error parameter computed from Equation 21 was less than 0.25 degrees, 0.25 was used.

TABLE 2

| | | | Weighted Azimuth Estimate | | |
|---|---|---|---|---|---|
| TI | AZ | AZ (0) | ERR (0) | AZ (weighted) | ERR (weighted) |
| 5 | 90 | 89.85 | 0.15 | 89.97 | 0.25 |
| 10 | 95 | 94.71 | 0.29 | 94.97 | 0.25 |
| 15 | 100 | 99.57 | 0.43 | 99.92 | 0.25 |
| 20 | 105 | 104.44 | 0.56 | 104.90 | 0.25 |
| 30 | 115 | 114.24 | 0.76 | 114.86 | 0.25 |
| 40 | 120 | 119.06 | 0.94 | 119.82 | 0.25 |
| 50 | 130 | 129.00 | 1.00 | 129.85 | 0.25 |
| 60 | 140 | 139.05 | 0.95 | 139.98 | 0.25 |
| 70 | 150 | 149.19 | 0.81 | 150.03 | 0.25 |
| 80 | 120 | 118.55 | 1.45 | 120.29 | 0.55 |
| 90 | 120 | 118.53 | 1.47 | 120.86* | 0.55 |
| 90 | 105 | 103.37 | 1.63 | 107.52* | 1.17 |
| 90 | 90 | 88.33 | 1.67 | 114.45* | 5.77 |

Note:
The values indicated * include the anomalous 180 degree value shown in Table 1.

The weighted azimuth value shown, AZ(weighted), and its associated error parameter, ERR(weighted), show the benefit of the method. A single result is shown for each survey station and the error parameter for the azimuth estimate is as low, or lower, than any such error parameter in any single method of correction shown in Table 1.

The essential elements of the invention described herein then are:

1) use of measured components of cross-borehole magnetic field components and reference data on the Earth's magnetic field to compute more than one estimate of the azimuthal orientation of the borehole, 2) computation of an error-indicative parameter for each of the individual estimates based on the uncertainties in the elements used to compute each of the individual estimated, 3) computation of a single estimate of the azimuthal orientation of the borehole from the individual estimates and their individual error-indicative parameters, and 4) computation of an error-indicative value for the single estimate.

The method shown in Equations 16 through 21 using three individual estimates of azimuth can readily be extended to cases with any number of individual estimates. The general procedure for weighted estimations is well known in the mathematical statistics field. In general, a series of measurements of some quantity, for example z, can be represented as the sum value, for example x, plus some unknown measurement error, for example v. The series of measurements may be written in vector/matrix notation as:

$$z = Hx + v \quad \text{(Eq. 22)}$$

where:

$$z = \begin{matrix} z1 \\ z2 \\ z3 \\ . \\ . \\ zn \end{matrix} \text{ an } n\text{-element measurement vector} \quad \text{(Eq. 23)}$$

$$x = \begin{matrix} x1 \\ . \\ . \\ xm \end{matrix} \text{ an } m\text{-element unkown vector} \quad \text{(Eq. 24)}$$

$H$ is an $n$- by $m$-element measurement matrix (Eq. 25)

$$v = \begin{matrix} v1 \\ v2 \\ v3 \\ . \\ . \\ vn \end{matrix} \text{ an } n\text{-element measurement error vector} \quad \text{(Eq. 26)}$$

The vector, v of measurement errors is further characterized in general by a matrix computed from its elements that is usually designated as the covariance matrix of the error vector and is often designated by the letter R. This matrix is computed as the expected value of the matrix product of the vector v and its transpose. Thus:

$$R = E(v*v^T) \quad \text{(Eq. 27)}$$

where:

E designates the expected value of the product.

Superscript T denotes the transpose.

With this definition and the terms defined above, it may be shown that the optimum estimate of the unknown elements in the vector, x, that minimizes the sum of the squared errors in the estimate is given by:

$$x=(H^T*R^{-1}*H)^{-1}*(H^T*R^{-1})*z \quad \text{(Eq.28)}$$

where:

* denotes matrix product

Superscript T is transpose

Superscript −1 denotes matrix inverse

The process described above in Equations 16 through 21 is the equivalent of Equation 28 noting that the measurement vector, z, is equivalent to the three computed values AZ(1), AZ(2) and AZ(3), the unknown vector, x, is the single estimate result, AZ(weighted), the measurement matrix, H, is a 3- by 1-element matrix having 1 for each element, and the measurement error vector, v, is equivalent to ERR(1), ERR(2) and ERR(3). It was further assumed in the example presented above that the three error parameters were uncorrelated with each other. That results in the covariance matrix, R, having diagonal form so that the simple results of Equations 16–21 can be written. If such correlation exists between error elements, the Equations 27 and 28 must be used to obtain the minimum error estimate of the values of the unknown vector, x.

Alternative formulations of the estimation problem may be applied in the survey problem. Instead of solving for more than one estimate of the azimuthal orientation of the borehole, it is possible to solve for more than one individual estimate of the cosine of the azimuthal orientation angle, solve for an error-indicative parameter for each such estimate, solve for a single weighted minimum-error value of the cosine of the azimuth angle, and then solve for a single estimate of azimuth from this value and the other measurements. Also, it is possible to compute more than one estimate for the unknown component of the Earth's magnetic field along the borehole axis, compute error-indicative parameters for each of the estimates, and then compute a single estimate of this component which could then be used in the azimuth solution. Each of these alternatives is equivalent in concept to the basic first method shown. Either of these alternatives may be desirable in some cases. In the computation of the individual error-indicative parameters that are used in the weighting process, the investigation of possible correlation between errors is somewhat simpler in these processes.

In summary, the methods of this invention produce a mathematically optimum estimate of the azimuthal orientation of a borehole from magnetic survey measurements that does not require any operator evaluation or selection of a preferred method for any particular borehole path or segment along the path. Further, a final indication of the probable error in the single estimate is provided.

Figure 3:
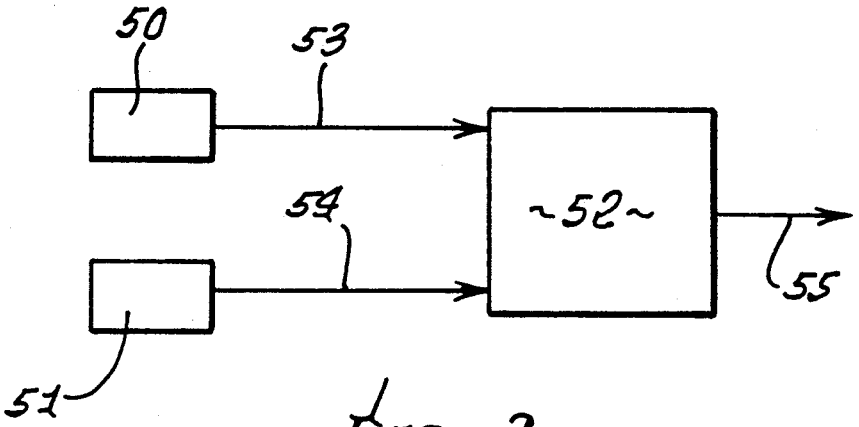
FIGS. 3–6 are block diagrams.

FIG. 3 shows apparatus for determining the orientation of the axis of a borehole with respect to an earth-fixed reference coordinate system at a location in the borehole, comprising a) means 50 for measuring one of the following:

i) two cross-borehole components, ii) two cross-borehole components and an along-borehole component, of the earth's gravity field, at said location in the borehole, b) means 51 for measuring two cross-borehole components of the earth's magnetic field at said locations, c) and means 52 operatively connected as at 53 and 54 with said means 50 and 51 for processing said measured components to determine a single estimate of the component of the earth's magnetic field along the borehole axis, and then to determine a value at 55 for the azimuthal orientation of the borehole axis.

Figure 4:
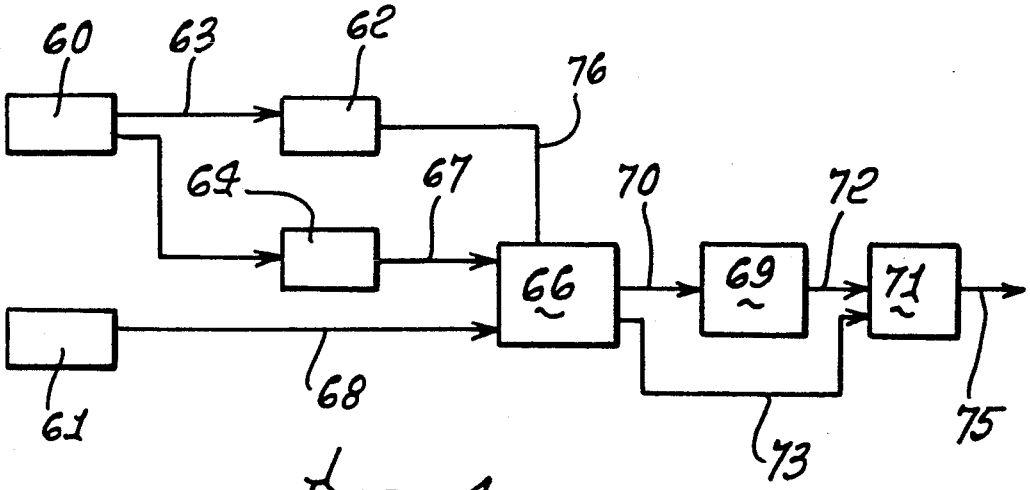

FIG. 4 shows other apparatus for determining the orientation of the axis of a borehole with respect to an earth-fixed reference coordinate system at a location in the borehole, comprising a) means 60 for measuring one of the following:

i) two cross-borehole components, ii) two cross-borehole components and an along-borehole component, of the earth's gravity field, at said location in the borehole, b) means 61 for measuring two cross-borehole components of the earth's magnetic field at said location, c) means 62 operatively connected at 63 with said means 60 for determining the inclination angle of the borehole axis from said gravity component measurements, d) means 64 operatively connected at 65 with said means 60 for determining the highside angle reference of the cross-borehole measured components of the earth's gravity and magnetic fields from said gravity component measurements, e) means 66 operatively connected at 67, 68 and 76 with said means 61, 62 and 64 for determining more than one individual estimate of the azimuthal orientation of the borehole axis from said inclination angle, said highside angle reference and said two measured cross-borehole components of the earth's magnetic field, f) means 69 operatively connected at 70 with said means 66 for determining an error indicative parameter for each said individual estimate of the azimuthal orientation of the borehole axis, and g) means 71 operatively connected at 72 and 73 with said means 66 and 69 for determining a single estimate at 75 of the azimuthal orientation of the borehole axis based on said individual estimates of azimuthal orientation and said error indicative parameters for each said estimate.

Figure 5:
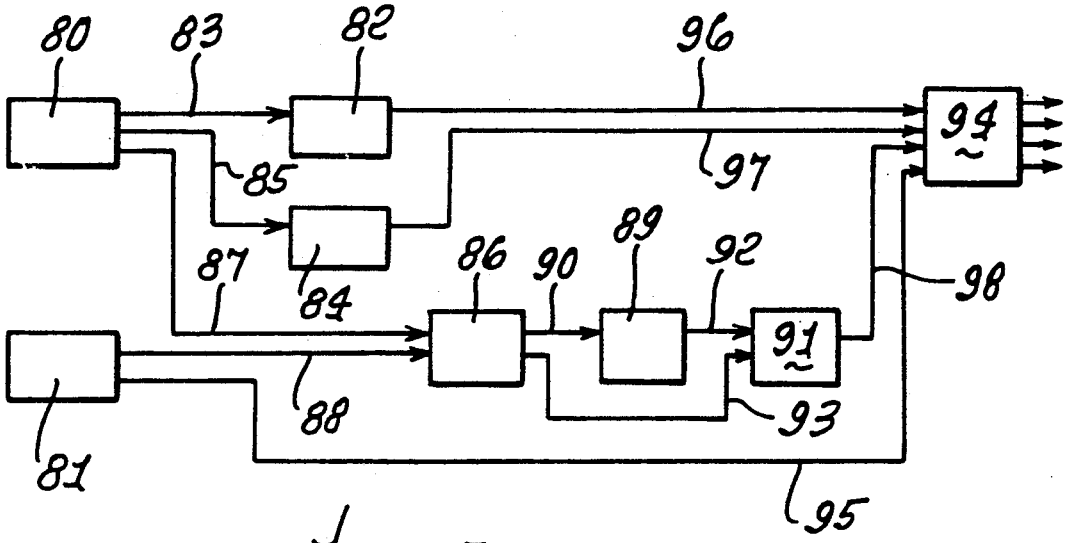

FIG. 5 shows further apparatus for determining the orientation of the axis of a borehole with respect to an earth-fixed reference coordinate system at a location in the borehole, comprising a) means 80 for measuring one of the following:

i) two cross-borehole components, ii) two cross-borehole components and an along-borehole component, of the earth's gravity field at said location in the borehole, b) means 81 for measuring two cross-borehole components of the earth's magnetic field at said location, c) means 82 operatively connected at 83 with said means 80 for determining the inclination angle of the borehole axis from said gravity component measurements, d) means 84 operatively connected at 85 with said means 80 for determining the highside angle reference of the cross-borehole measured components of the earth's gravity and magnetic fields from said gravity component measurements, e) means 86 operatively connected at 87 and 88 with said means 80 and 81 for determining more than one individual estimate of the component of the earth's magnetic field along the borehole axis from said measured gravity and magnetic field components, f) means 89 operatively connected at 90 with said means 86 for determining an error indicative parameter for each said individual estimate of the component of the earth's magnetic field along the borehole axis, g) means 91 operatively connected at 92 and 93 with said means 86 and 89 for determining a single estimate of the component of the earth's magnetic field along the borehole axis based on said individual estimates of the component of the earth's magnetic field along the borehole axis and said error indicative parameters for each said estimate, and h) means 94 operatively connected at 95–98 with said means 81, 82, 84 and 91 for determining the azimuthal orientation of the borehole axis from said inclination angle, said highside angle reference, said two measured cross-borehole components of the earth's magnetic field and said single estimate of the component of the earth's magnetic field along the borehole axis.

Figure 6:
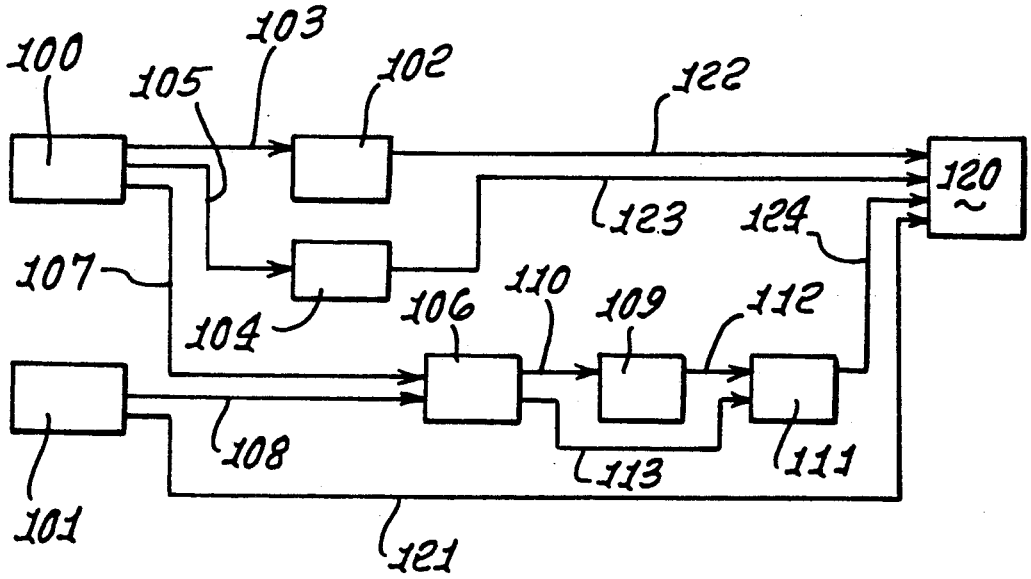

Finally, FIG. 6 shows apparatus for determining the orientation of the axis of a borehole with respect to an earth-fixed reference coordinate system at a location in the borehole, comprising a) means 100 for measuring one of the following:

i) two cross-borehole components, ii) two cross-borehole components and an along-borehole component, of the earth's gravity field, at said location in the borehole, b) means 101 for measuring two cross-borehole components of the earth's magnetic field at said location, c) means 102 operatively connected at 103 to said means 100 for determining the inclination angle of the borehole axis from said gravity component measurements, d) means 104 operatively connected at 105 to said means 100 for determining the highside angle reference of the cross-borehole measured components of the earth's gravity and magnetic fields from said gravity component measurements, e) means 106 operatively connected at 107 and 108 with said means 100 and 101 for determining more than one individual estimate of the cosine of the azimuth orientation angle of the borehole axis from said measured gravity and magnetic field components, f) means 109 operatively connected at 110 with said 106 means for determining an error indicative parameter for each said individual estimate of the cosine of the azimuth orientation angle of the borehole axis, g) means 111 operatively connected at 112 and 113 with means 106 and 109 for determining a single estimate of the cosine of the azimuth orientation angle of the borehole axis based on said individual estimates of the cosine of the azimuth orientation angle of the borehole axis and said error indicative parameters for each said estimate, and h) means 110 operatively connected at 112–115 with said 101, 102, 104 and 111 means for determining the azimuthal orientation of the borehole axis from said inclination angle, said highside angle reference, said two measured cross-borehole components of the earth's magnetic field and said single estimate of the cosine of the azimuth orientation angle of the borehole axis.

Blocks shown in FIGS. 3–6, other than sensors, typically comprise portions of a computer program that performs operation indicated by the equations set forth above. Alternatively, they can be hand wired in the form of circuit elements performing such functions.

Figure 7:
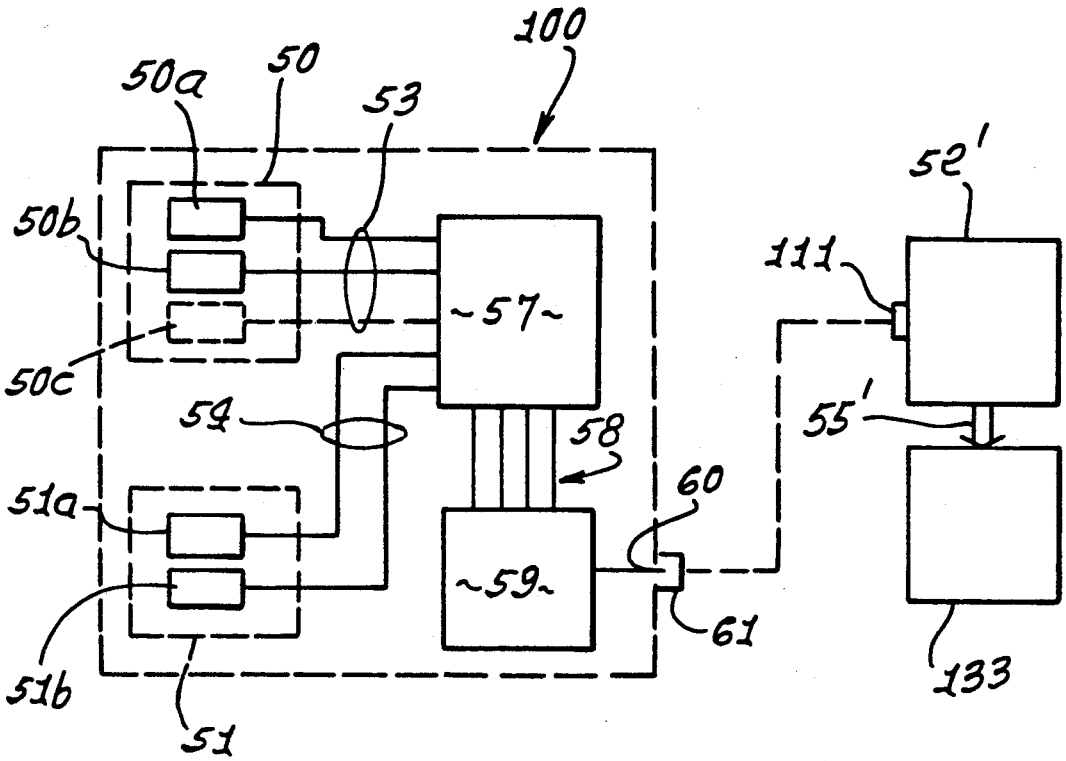
FIGS. 7–9 are circuit diagrams.

FIG. 7 shown, in somewhat more detail, elements of FIG. 3, and also itemized below. In this diagram 52' and 55' correspond respectively with 52 and 55 in FIG. 3. Data from sensors 50 and 51 is stored at 59 internally of the survey tool 100, for subsequent processing by computer 52' after recovery of tool 100 from the borehole. The remaining elements in FIG. 7 are listed as:

| | |
|---|---|
| 100 | Magnetic survey tool |
| 50 | Means for measuring the earth's gravity field |
| 50a | First accelerometer normal to borehole |
| 50b | Second accelerometer normal to borehole and normal to 50c |
| 50c | Optional third accelerometer along borehole |
| 51 | Means for measuring the earth's magnetic field |
| 51a | First magnetometer normal to borehole |
| 51b | Second magnetometer normal to borehole and normal to 51a |
| 53, 54 | Signal outputs |
| 57 | Signal conditioning and analog-to-digital conversions |
| 58 | Parallel digital outputs representative of the sensed data |
| 59 | Digital data memory |
| 60 | Memory output port |
| 61 | Memory output connector |
| 52' | Surface digital computer |
| 111 | Computer input port |
| 55' | Computer output |
| 113 | Control/display indicator for output azimuth and other variable |

Figure 8:
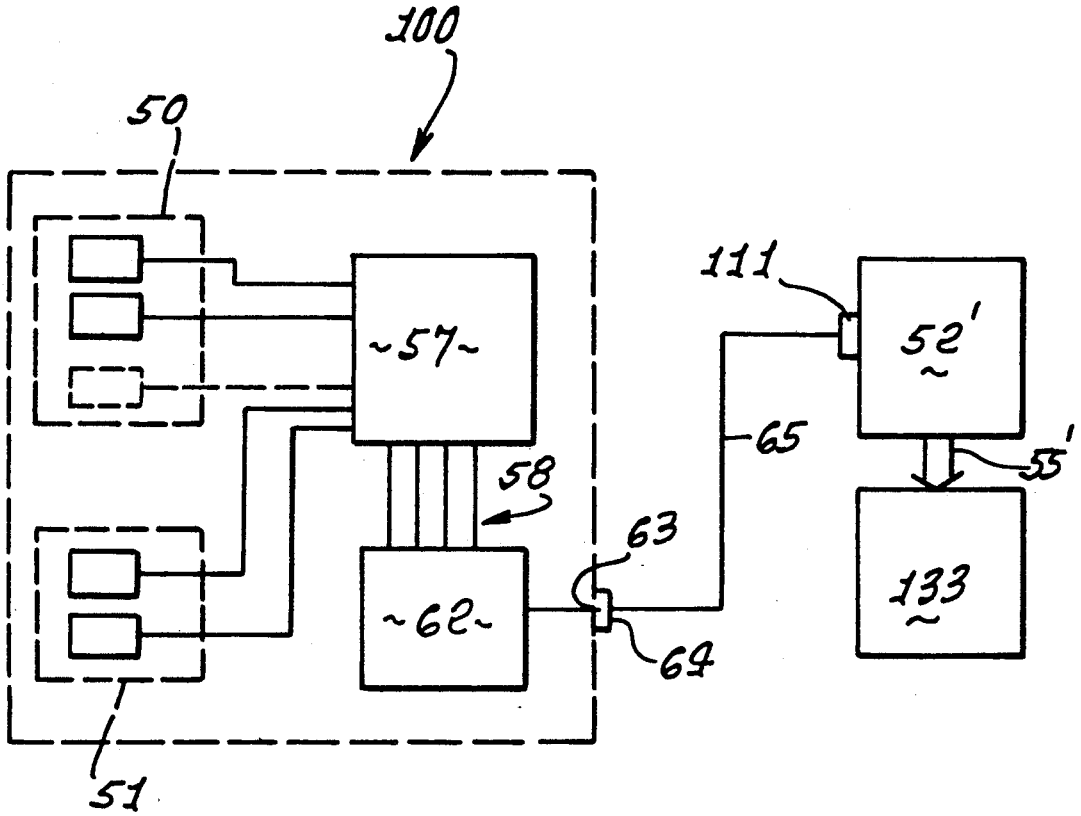

FIG. 8 is like FIG. 7, however the sensor data is here transmitted, as measured, to the surface, via link 65, (by wire line or other communication means) for use in real time by the surface computer 52'. Elements varying from those in FIG. 7 are listed as follows:

| | |
|---|---|
| 62 | Signal transmitter |
| 63 | Signal output lead |
| 64 | Signal output connector |
| 65 | Transmission path or link |

Figure 9:
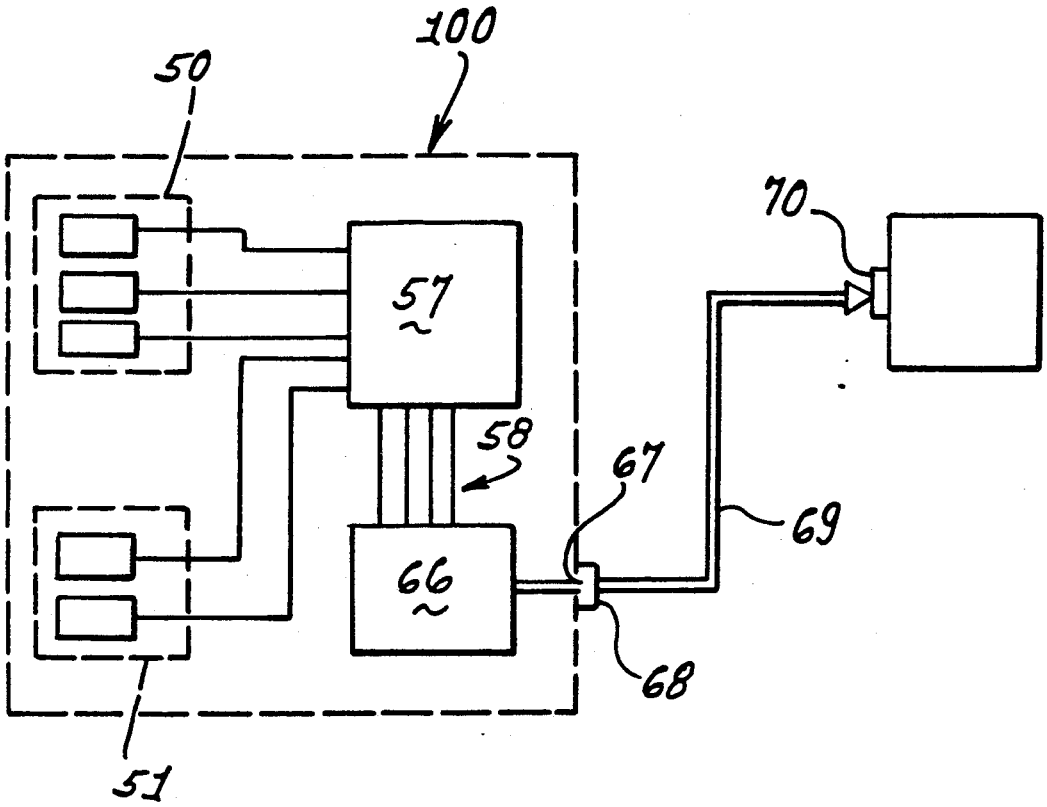

FIG. 9 is like FIG. 7; however, the sensor data is here processed by a computer 66 within the downhole tool and the resultant azimuth and inclination data is transmitted to the surface, as by wire line or other communication line means 69. Elements varying from those of FIG. 7 are listed as follows:

| | |
|---|---|
| 66 | Downhole digital computer and signal transmitter |
| 67 | Signal output lead |
| 68 | Signal output connector |
| 69 | Tranquisition path |
| 70 | Control/display indicator input connector |

I claim:

1. A method for determining the orientation of the axis of a borehole with respect to an earth-fixed reference coordinate system at a location in the borehole comprising the steps of:

a) measuring one of the following:

i) two cross-borehole components,
ii) two cross-borehole components and an along-borehole component,
of the earth's gravity field, at said location in the borehole, b) measuring two cross-borehole components of the earth's magnetic field at said location, c) determining the inclination angle of the borehole axis from said gravity component measurements, d) determining the highside angle reference of the cross-borehole measured components of the earth's gravity and magnetic fields from said gravity component measurements, e) determining more than one individual estimate of the azimuthal orientation of the borehole axis from said inclination angle, said highside angle reference and said two measured cross-borehole components of the earth's magnetic field, f) determining an error indicative parameter for each said individual estimate of the azimuthal orientation of the borehole axis, and g) determining a single estimate of the azimuthal orientation of the borehole axis based on said individual estimates of azimuthal orientation and said error indicative parameters for each said estimate.

2. The method of claim 1 wherein one estimate of the azimuthal orientation of step e) is determined using a known value for the earth's magnetic field vertical component.

3. The method of claim 1 wherein one estimate of the azimuthal orientation of step e) is determined using a known value for the earth's magnetic field horizontal component.

4. The method of claim 1 wherein one estimate of the azimuthal orientation of step e) is determined using a known value for the earth's magnetic field total magnitude.

5. The method of claim 1 wherein one estimate of the azimuthal orientation of step e) is determined using known values for the earth's magnetic field total magnitude and dip angle.

6. The method of claim 1 wherein one estimate of the azimuthal orientation of step e) is determined using a known value for the cross-borehole components of the earth's gravity and magnetic fields at each of at least two locations along the borehole axial direction.

7. The method of claim 1 wherein the determination of said error indicative parameters in step f) is made by the arbitrary assignment of equal parameters to all of the individual estimates of azimuthal orientation.

8. The method of claim 1 wherein the determination of said error indicative parameters in step f) is made by computations based on assumed known sensor and reference data error models.

9. The method of claim 1 wherein the determination of said single estimate of azimuthal orientation made from said individual estimates and error indicative parameters in said step g) is made by a simple average of the individual estimates.

10. The method of claim 1 wherein the determination of said single estimate of azimuthal orientation made from said individual estimates and error indicative parameters in said step g) is made by a weighted average using said error indicative parameters as the appropriate weighting for each said individual estimate.

11. The method of claim 1 wherein the determination of said single estimate of azimuthal orientation made from said individual estimates and error indicative parameters in said step g) is made by an optimally weighted estimate using said individual estimates of azimuth and the covariance matrix of said error indicative parameters for the individual estimates.

12. A method for determining the orientation of the axis of a borehole with respect to an earth-fixed reference coordinate system at a location in the borehole comprising the steps of:

a) measuring one of the following:
i) two cross-borehole components,
ii) two cross-borehole components and an along-borehole component,
of the earth's gravity field at said location in the borehole, b) measuring two cross-borehole components of the earth's magnetic field at said location, c) determining the inclination angle of the borehole axis from said gravity component measurements, d) determining the highside angle reference of the cross-borehole measured components of the earth's gravity and magnetic fields from said gravity component measurements, e) determining more than one individual estimate of the component of the earth's magnetic field along the borehole axis from said measured gravity and magnetic field components, f) determining an error indicative parameter for each said individual estimate of the component of the earth's magnetic field along the borehole axis, g) determining a single estimate of the component of the earth's magnetic field along the borehole axis based on said individual estimates of the component of the earth's magnetic field along the borehole axis and said error indicative parameters for each said estimate, and h) determining the azimuthal orientation of the borehole axis from said inclination angle, said highside angle reference, said two measured cross-borehole components of the earth's magnetic field and said single estimate of the component of the earth's magnetic field along the borehold axis.

13. The method of claim 12 wherein one estimate of the component of the earth's magnetic field along the borehole axis of step e) is determined using a known value for the earth's magnetic field vertical component.

14. The method of claim 12 wherein one estimate of the component of the earth's magnetic field along the borehole axis of step e) is determined using a known value for the earth's magnetic field horizontal component.

15. The method of claim 12 wherein one estimate of the component of the earth's magnetic field along the borehole axis of step e) is determined using a known value for the earth's magnetic field total magnitude.

16. The method of claim 12 wherein one estimate of the component of the earth's magnetic field along the borehole axis of step e) is determined using known values for the earth's magnetic field total magnitude and dip angle.

17. The method of claim 12 wherein one estimate of the component of the earth's magnetic field along the borehole axis of step e) is determined using a known value for the cross-borehole components of the earth's gravity and magnetic fields at each of at least two locations along the borehole axial direction.

18. The method of claim 12 wherein the determination of said error indicative parameters in step f) is made by the arbitrary assignment of equal parameters to all of the individual estimates of the component of the earth's magnetic field along the borehole axis.

19. The method of claim 12 wherein the determination of said error indicative parameters in step f) is made by computations based on assumed known sensor and reference date error models.

20. The method of claim 12 wherein the determination of said single estimate of the component of the earth's magnetic field along the borehole axis made from said individual estimates and error indicative parameters in said step g) is made by a simple average of the individual estimates.

21. The method of claim 12 wherein the determination of said single estimate of the component of the earth's magnetic field along the borehole axis made from said individual estimates and error indicative parameters in said step g) is made by a weighted average using said error indicative parameters as the appropriate weighting for each said individual estimate.

22. The method of claim 12 wherein the determination of said single estimate of the component of the earth's magnetic field along the borehole axis made from said individual estimates and error indicative parameters in said step g) is made by an optimally weighted estimate using said individual estimates and the covariance matrix of said error indicative parameters for the individual estimates.

23. A method for determining the orientation of the axis of a borehole with respect to an earth-fixed reference coordinate system at a location in the borehole comprising the steps of:

a) measuring one of the following:
   i) two cross-borehole components,
   ii) two cross-borehole components and an along-borehole component,
   of the earth's gravity field, at said location in the borehole,
b) measuring two cross-borehole components of the earth's magnetic field at said location,
c) determining the inclination angle of the borehole axis from said gravity component measurements,
d) determining the highside angle reference of the cross-borehole measured components of the earth's gravity and magnetic fields from said gravity component measurements,
e) determining more than one individual estimate of the cosine of the azimuth orientation angle of the borehole axis from said measured gravity and magnetic field components,
f) determining an error indicative parameter for each said individual estimate of the cosine of the azimuth orientation angle of the borehole axis,
g) determining a single estimate of the cosine of the azimuth orientation angle of the borehole axis based on said individual estimates of the cosine of the azimuth orientation angle of the borehole axis and said error indicative parameters for each said estimate, and
h) determining the azimuthal orientation of the borehole axis from said inclination angle, said highside angle reference, said two measured cross-borehole components of the earth's magnetic field and said single estimate of the cosine of the azimuth orientation angle of the borehole axis.

24. The method of claim 23 wherein one estimate of the cosine of the azimuth orientation angle of the borehole axis of step e) is determined using a known value for the earth's magnetic field vertical component.

25. The method of claim 23 wherein one estimate of the cosine of the azimuth orientation angle of the borehole axis of step e) is determined using a known value for the earth's magnetic field horizontal component.

26. The method of claim 23 wherein one estimate of the cosine of the azimuth orientation angle of the borehole axis of step e) is determined using a known value for the earth's magnetic field total magnitude.

27. The method of claim 23 wherein one estimate of the cosine of the azimuth orientation angle of the borehole axis of step d) is determined using known values for the earth's magnetic field total magnitude and dip angle.

28. The method of claim 23 wherein one estimate of the cosine of the azimuth orientation angle of the borehole axis of step e) is determined using a known value for the cross-borehole components of the earth's gravity and magnetic fields at more than one location along the borehole axial direction.

29. The method of claim 23 wherein the determination of said error indicative parameters in step f) is made by the arbitrary assignment of equal parameters to all of the individual estimates of the cosine of the azimuth orientation angle of the borehole axis.

30. The method of claim 23 wherein the determination of said error indicative parameters in step f) is made by computations based on assumed known sensor and reference data error models.

31. The method of claim 23 wherein the determination of said single estimate of the cosine of the azimuth orientation angle of the borehole axis made from said individual estimates and error indicative parameters in said step g) is made by a simple average of the individual estimates.

32. The method of claim 23 wherein the determination of said single estimate of the cosine of the azimuth orientation angle of the borehole axis made from said individual estimates and error indicative parameters in said step g) is made by a weighted average using said error indicative parameters as the appropriate weighting for each said individual estimate.

33. The method of claim 23 wherein the determination of said single estimate of the cosine of the azimuth orientation angle of the borehole axis made from said individual estimates and error indicative parameters in said step g) is made by an optimally weighted estimate using said individual estimates and the covariance matrix of said error indicative parameters for the individual estimates.

34. The method of claim 1 or 12 or 23 wherein said error indicative parameters of the said individual estimates are used to determine an error indicative parameter for said single estimate determined in said step g).

35. A method for determining the orientation of the axis of a borehole with respect to an earth-fixed reference coordinate system at a location in the borehole, comprising the steps of:

a) measuring one of the following:
   i) two cross-borehole components,
   ii) two cross-borehole components, and an along-borehole component,
   of the earth's gravity field, at said location in the borehole,
b) measuring two cross-borehole components of the earth's magnetic field at said locations, and
c) processing said step a) and step b) measured components to determine multiple estimates of the component of the earth's magnetic field along the borehole axis, said multiple estimates having different errors that are combinable to derive a single estimate of minimum error, and then to determine a value for the azimuthal orientation of the borehole axis.

36. In apparatus for determining the orientation of the axis of a borehole with respect to an earth-fixed reference coordinate system at a location in the borehole, comprising the steps of:

a) means for measuring one of the following:
i) two cross-borehole components,
ii) two cross-borehole components and an along-borehole component,
of the earth's gravity field, at said location in the borehole, b) means for measuring two cross-borehole components of the earth's magnetic field at said locations, c) and means operatively connected with said a) and b) means for processing said step a) and step b) measured components to determine multiple estimates of the component of the earth's magnetic field along the borehole axis, said multiple estimates having different errors that are combinable to derive a single estimate of minimum error then to determine a value for the azimuthal orientation of the borehole axis.

37. An apparatus for determining the orientation of the axis of a borehole with respect to an earth-fixed reference coordinate system at a location in the borehole comprising the steps of:

a) means for measuring one of the following:
i) two cross-borehole components,
ii) two cross-borehole components and an along-borehole component,
of the earth's gravity field, at said location in the borehole, b) means for measuring two cross-borehole components of the earth's magnetic field at said location, c) means operatively connected with said a) means for determining the inclination angle of the borehole axis from said gravity component measurements, d) means operatively connected with said a) means for determining the highside angle reference of the cross-borehole measured components of the earth's gravity and magnetic fields from said gravity component measurements, e) means operatively connected with said b), c) and d) means for determining more than one individual estimate of the azimuthal orientation of the borehole axis from said inclination angle, said highside angle reference and said two measured cross-borehole components of the earth's magnetic field, f) means operatively connected with said e) means for determining an error indicative parameter for each said individual of the azimuthal orientation of the borehole axis, and g) means operatively connected with said e) and f) means for determining a single estimate of the azimuthal orientation of the borehole axis based on said individual estimates of azimuthal orientation and said error indicative parameters for each said estimate.

38. An apparatus for determining the orientation of the axis of a borehole with respect to an earth-fixed reference coordinate system at a location in the borehole comprising the steps of:

a) means for measuring one of the following:
i) two cross-borehole components,
ii) two cross-borehole components and an along-borehole component,
of the earth's gravity field at said location in the borehole, b) means for measuring two cross-borehole components of the earth's magnetic field at said location, c) means operatively connected with said a) means for determining the inclination angle of the borehole axis from said gravity component measurements, d) means operatively connected with said a) means for determining the highside angle reference of the cross-borehole measured components of the earth's gravity and magnetic fields from said gravity component measurements, e) means operatively connected with said b), c) and d) means for determining more than one individual estimate of the component of the earth's magnetic field along the borehole axis from said measured gravity and magnetic field components, f) means operatively connected with said e) means for determining an error indicative parameter for each said individual estimate of the component of the earth's magnetic field along the borehole axis, g) means operatively connected with said e) and f) means for determining a single estimate of the component of the earth's magnetic field along the borehole axis based on said individual estimates of the component of the earth's magnetic field along the borehole axis and said error indicative parameters for each said estimate, and h) means operatively connected with said c), d), b) and g) means for determining the azimuthal orientation of the borehole axis from said inclination angle, said highside angle reference, said two measured cross-borehole components of the earth's magnetic field and said single estimate of the component of the earth's magnetic field along the borehole axis.

39. An apparatus for determining the orientation of the axis of a borehole with respect to an earth-fixed reference coordinate system at a location in the borehole comprising the steps of:

a) means for measuring one of the following:
i) two cross-borehole components,
ii) two cross-borehole components and an along-borehole component,
of the earth's gravity field, at said location in the borehole, b) means for measuring two cross-borehole components of the earth's magnetic field at said location, c) means operatively connected to said a) means for determining the inclination angle of the borehole axis from said gravity component measurements, d) means operatively connected to said a) means for determining the highside angle reference of the cross-borehole measured components of the earth's gravity and magnetic fields from said gravity component measurements, e) means operatively connected with said b), c) and d) means for determining more than one individual estimate of the cosine of the azimuth orientation angle of the borehole axis from said measured gravity and magnetic field components, f) means operatively connected with said e) means for determining an error indicative parameter for each said individual estimate of the cosine of the azimuth orientation angle of the borehole axis, g) means operatively connected with said e) and f) means for determining a single estimate of the cosine of the azimuth orientation angle of the borehole axis based on said individual estimates of the cosine of the azimuth orientation angle of the borehole axis and said error indicative parameters for each said estimate, and h) means operatively connected with said c), d), b), and g) means for determining the azimuthal orientation of the borehole axis from said inclination angle, said highside angle reference, said two measured cross-borehole components of the earth's magnetic field and said single estimate of the cosine of the azimuth orientation angle of the borehole axis.

* * * * *